US011002457B2

(12) United States Patent
Turney et al.

(10) Patent No.: US 11,002,457 B2
(45) **Date of Patent: *May 11, 2021**

(54) VARIABLE REFRIGERANT FLOW, ROOM AIR CONDITIONER, AND PACKAGED AIR CONDITIONER CONTROL SYSTEMS WITH COST TARGET OPTIMIZATION

(71) Applicant: Johnson Controls Technology Company, Auburn Hills, MI (US)

(72) Inventors: Robert D. Turney, Watertown, WI (US); Henry O. Marcy, V, Milwaukee, WI (US); Zhizhong Pang, Tokyo (JP)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/404,030

(22) Filed: May 6, 2019

(65) Prior Publication Data

US 2019/0338973 A1 Nov. 7, 2019

Related U.S. Application Data

(60) Provisional application No. 62/667,979, filed on May 7, 2018.

(51) Int. Cl.
*F24F 11/47* (2018.01)
*F24F 11/755* (2018.01)
*F24F 11/85* (2018.01)

(52) U.S. Cl.
CPC ..... *F24F 11/47* (2018.01); *F24F 11/755* (2018.01); *F24F 11/85* (2018.01)

(58) Field of Classification Search
CPC ..... F24F 11/47; F24F 11/755; F24F 11/85; F24F 11/64; F24F 3/065
See application file for complete search history.

(56) References Cited

U.S. PATENT DOCUMENTS 5,135,045 A 8/1992 Moon
6,780,011 B2 8/2004 Davidov et al.
(Continued)

FOREIGN PATENT DOCUMENTS

CN 101140450 3/2008
CN 102375443 3/2012
(Continued)

OTHER PUBLICATIONS

U.S. Appl. No. 15/920,077, filed Mar. 13, 2018, Johnson Controls Technology Company.
(Continued)

*Primary Examiner* — Ziaul Karim
(74) *Attorney, Agent, or Firm* — Foley & Lardner LLP

(57) ABSTRACT

A building cooling system includes a controller and a cooling device operable to affect indoor air temperature of a building. The controller is configured to obtain a cost function that characterizes a cost of operating the cooling device over a future time period, obtain a dataset relating to the building, determine a current state of the building by applying the dataset to a neural network, select a temperature bound associated with the current state, augment the cost function to include a penalty term that increases the cost when the indoor air temperature violates the temperature bound, and determine a temperature setpoint for each of a plurality of time steps in the future time period. The temperature setpoints achieve a target value of the cost function over the future time period. The controller is configured to control the cooling device to drive the indoor air temperature towards the temperature setpoint.

20 Claims, 12 Drawing Sheets

(56) References Cited

U.S. PATENT DOCUMENTS

| | | | | |
|---|---|---|---|---|
| 7,580,775 | B2 | 8/2009 | Kulyk et al. | |
| 7,894,946 | B2 | 2/2011 | Kulyk et al. | |
| 8,527,108 | B2 | 9/2013 | Kulyk et al. | |
| 8,527,109 | B2 | 9/2013 | Kulyk et al. | |
| 8,918,223 | B2 | 12/2014 | Kulyk et al. | |
| 9,110,647 | B2 | 8/2015 | Kulyk et al. | |
| 9,250,633 | B2 | 2/2016 | Chen et al. | |
| 9,429,923 | B2 | 8/2016 | Ward et al. | |
| 9,703,339 | B2 | 7/2017 | Kulyk et al. | |
| 10,139,877 | B2 | 11/2018 | Kulyk et al. | |
| 10,146,237 | B2 | 12/2018 | Turney et al. | |
| 2007/0168057 | A1* | 7/2007 | Blevins | G05B 13/022 700/53 |
| 2007/0231119 | A1* | 10/2007 | Shen | F04D 27/004 415/47 |
| 2011/0106328 | A1* | 5/2011 | Zhou | G05B 13/024 700/291 |
| 2013/0013118 | A1 | 1/2013 | Merkulov et al. | |
| 2013/0013124 | A1 | 1/2013 | Park et al. | |
| 2014/0288890 | A1 | 9/2014 | Khainson et al. | |
| 2015/0168003 | A1* | 6/2015 | Stefanski | F24F 11/70 165/237 |
| 2015/0316901 | A1 | 11/2015 | Wenzel et al. | |
| 2016/0305678 | A1* | 10/2016 | Pavlovski | F24F 11/62 |
| 2017/0003150 | A1 | 1/2017 | Noboa et al. | |
| 2017/0211830 | A1* | 7/2017 | Kosaka | G05B 19/048 |
| 2017/0364105 | A1* | 12/2017 | Greene | G05D 23/1904 |
| 2018/0197253 | A1 | 7/2018 | Elbsat et al. | |
| 2018/0224814 | A1 | 8/2018 | Elbsat et al. | |
| 2018/0285800 | A1 | 10/2018 | Wenzel et al. | |
| 2018/0313557 | A1 | 11/2018 | Turney et al. | |
| 2018/0357577 | A1 | 12/2018 | Elbsat et al. | |
| 2019/0079473 | A1 | 3/2019 | Kumar et al. | |
| 2019/0158305 | A1 | 5/2019 | Cui et al. | |
| 2019/0171171 | A1 | 6/2019 | Verteletskyi et al. | |
| 2019/0187634 | A1 | 6/2019 | Fan et al. | |
| 2019/0287147 | A1 | 9/2019 | Ingale et al. | |
| 2019/0338973 | A1 | 11/2019 | Turney et al. | |
| 2020/0072543 | A1 | 3/2020 | Turney et al. | |

FOREIGN PATENT DOCUMENTS

| | | | | |
|---|---|---|---|---|
| CN | 104620182 | | 5/2015 | |
| CN | 105247519 | A * | 1/2016 | G06Q 10/06 |
| JP | 2009-518750 | | 5/2009 | |
| JP | 2017-133707 | A | 8/2017 | |
| WO | WO-2016/201353 | A1 | 12/2016 | |

OTHER PUBLICATIONS

U.S. Appl. No. 16/122,399, filed Sep. 5, 2018, Johnson Controls Technology Company.

Batterman, Stuart. Review and Extension of CO2-Based Methods to Determine Ventilation Rates with Application to School Classrooms. International Journal of Environmental Research and Public Health. Feb. 4, 2017. 22 Pages.

Chen, Xiao; Wang, Qian; Srebric, Jelena. Occupant Feedback Based Model Predictive Control for Thermal Comfort and Energy Optimization: A Chamber Experimental Evaluation. Applied Energy 164. 2016, pp. 341-351.

Kang et al., Novel Modeling and Control Strategies for a HVAC System Including Carbon Dioxide Control. Jun. 2, 2014. 19 Pages.

Lampinen, Markku J. Thermodynamics of Humid Air. Sep. 2015. 39 Pages.

Luo, Xiaoyan. Maximizing Thermal Comfort and International Design. Loughborough University. Jan. 18, 2019. 4 Pages.

Sama Aghniaey et al., The Assumption of Equidistance in the Seven-Point Thermal Sensation Scale and a Comparison between Categorical and Continuous Metrics. University of Georgia College of Engineering, Jan. 18, 2019. 4 Pages.

Sudhakaran, Saurabh; Shaurette Mark. Temperature, Relative Humidity, and CarbonDioxide Modulation in a Near-Zero Energy Efficient Retrofit House. Purdue University. 2016, 11 Pages.

Weekly, Kevin et al., Modeling and Estimation of the Humans' Effect on the CO2 Dynamics Inside a Conference Room. IEEE Transactions on Control Systems Technology, Vol. 23, No. 5, Sep. 2015, 12 pages.

Ward et al., "Beyond Comfort—Managing the Impact of HVAC Control on the Outside World," Proceedings of Conference: Air Conditioning and the Low Carbon Cooling Challenge, Cumberland Lodge, Windsor, UK, London: Network for Comfort and Energy Use in Buildings, http://nceub.org.uk, Jul. 27-29, 2008, 15 pages.

Office Action on IN 201944017378, dated Jul. 29, 2020, 6 pages.

Office Action on JP 2019-086368, dated Jul. 28, 2020, 7 pages with English translation.

Office Action on CN 201910372048.8, dated Sep. 17, 2020, 30 pages with English language translation.

* cited by examiner

1100

$5^6$ Classifications

Outside Air Temp
1. Extreme hot
2. Hot
3. Normal
4. Cold
5. Extreme cold

Cold Load
1. Extreme heavy
2. Heavy
3. Normal
4. Light
5. Extreme light

Season
1. Winter
2. Spring
3. Summer
4. Fall
5. Special

Humidity
1. Extreme humid
2. Humid
3. Normal
4. Dry
5. Extreme dry

Hot Load
1. Extreme heavy
2. Heavy
3. Normal
4. Light
5. Extreme light

Curtailment
1. Extreme Curtail
2. Curtail
3. No Curtail
4. Savings Mode
5. Extreme savings mode

FIG. 11

VARIABLE REFRIGERANT FLOW, ROOM AIR CONDITIONER, AND PACKAGED AIR CONDITIONER CONTROL SYSTEMS WITH COST TARGET OPTIMIZATION

CROSS-REFERENCE TO RELATED APPLICATION

This application claims the benefit of and priority to U.S. Provisional Patent Application No. 62/667,979, filed May 7, 2018, the entire disclosure of which is incorporated by reference herein.

BACKGROUND

The present disclosure relates generally to managing energy costs in variable refrigerant flow (VRF) systems, room air conditioning (RAC) systems, or packaged air conditioning (PAC) systems that provide temperature control for a building. Minimizing energy consumption of such systems may lead to discomfort for occupants of the building because comfortable temperatures cannot be maintained without increased power, while precisely matching occupant preferences at all times typically leads to high energy costs. Thus, systems and methods are needed to reduce energy consumption of VRF, RAC, and PAC systems without leading to occupant discomfort.

SUMMARY

One implementation of the present disclosure is a building cooling system. The building cooling system includes a controller and a cooling device operable to affect an indoor air temperature of a building. The controller is configured to obtain a cost function that characterizes a cost of operating the cooling device over a future time period, obtain a dataset comprising a plurality of data points relating to the building, determine a current state of the building by applying the dataset to a neural network configured to classify the current state of the building, select a temperature bound associated with the current state, augment the cost function to include a penalty term that increases the cost when the indoor air temperature violates the temperature bound, and determine a temperature setpoint for each of a plurality of time steps in the future time period. The temperature setpoints achieves a target value of the cost function over the future time period. The controller is also configured to control the cooling device to drive the indoor air temperature towards the temperature setpoint for a first time step of the plurality of time steps.

In some embodiments, the temperature bound includes an upper limit on the indoor air temperature and a lower limit on the indoor air temperature. In some embodiments, the penalty term is zero when the indoor air temperature is between the upper limit and the lower limit and the penalty term is non-zero when the indoor air temperature is above the upper limit or below the lower limit. In some embodiments, the temperature bound includes a first temperature bound that includes a first upper limit on the indoor air temperature and a first lower limit on the indoor air temperature and a second temperature bound that includes a second upper limit on the indoor air temperature and a second lower limit on the indoor air temperature.

In some embodiments, the penalty term increases the cost by a first amount when the first temperature bound is violated and by a second amount when the second temperature bound is violated, the second amount greater than the first amount. In some embodiments, the first upper limit is less than the second upper limit and the first lower limit is greater than the second lower limit.

In some embodiments, the controller is configured to generate a graphical user interface that prompts a user to input the target value of the cost function.

In some embodiments, the controller is configured to store a mapping between a plurality of possible states of the building and a plurality of possible temperature bounds. The plurality of possible states includes the current state and the plurality of possible temperature bounds includes the temperature bound.

In some embodiments, the cooling device includes a variable refrigerant flow unit, a room air conditioning unit, or a packaged air conditioning unit.

Another implementation of the present disclosure is a method. The method includes obtaining a cost function that characterizes a cost of operating a cooling device over a future time period. The cooling device is configured to affect an indoor air temperature of a space. The method also includes obtaining a dataset that includes a plurality of data points relating to the space, determining a current state of the space by applying the dataset to a neural network configured to classify the current state of the space, selecting a temperature bound associated with the current state, augmenting the cost function to include a penalty term that increases the cost when the indoor air temperature violates the temperature bound, and determining a temperature setpoint for each of a plurality of time steps in the future time period. The temperature setpoints achieve a target value of the cost function over the future time period. The method includes controlling the cooling device to drive the indoor air temperature towards the temperature setpoint for a first time step of the plurality of time steps.

In some embodiments, the temperature bound includes an upper limit on the indoor air temperature and a lower limit on the indoor air temperature, the penalty term is zero when the indoor air temperature is between the upper limit and the lower limit, and the penalty term is non-zero when the indoor air temperature is above the upper limit or below the lower limit.

In some embodiments, the temperature bound includes a first temperature bound that includes a first upper limit on the indoor air temperature and a first lower limit on the indoor air temperature and a second temperature bound that includes a second upper limit on the indoor air temperature and a second lower limit on the indoor air temperature.

In some embodiments, the first upper limit is less than the second upper limit and the first lower limit is greater than the second lower limit. The penalty term increases the cost by a first amount when the first temperature bound is violated and by a second amount when the second temperature bound is violated. The second amount is greater than the first amount.

In some embodiments, the method includes prompting a user to input the target value of the cost function via a graphical user interface. In some embodiments, the method includes displaying a graphical representation of the temperature bound for the future time period and the temperature setpoints for the future time period.

In some embodiments, the cooling device includes a variable refrigerant flow unit, a room air conditioning unit, or a packaged air conditioning unit.

Another implementation of the present disclosure is one or more non-transitory computer-readable media containing program instructions that, when executed by one or more processors, cause the one or more processors to perform operations. The operations include obtaining a cost function that characterizes a cost of operating cooling equipment over a future time period. The cooling equipment is configured to affect an indoor air temperature of one or more buildings. The cooling equipment includes one or more of a variable refrigerant flow system, a room air conditioning system, or a packaged air conditioning system. The operations include obtaining a dataset comprising a plurality of data points relating to the one or more buildings, determining a current state of the one or more buildings by applying the dataset to a neural network configured to classify the current state of the one or more buildings, selecting a temperature bound associated with the current state, augmenting the cost function to include a penalty term that increases the cost when the indoor air temperature violates the temperature bound, and determining a temperature setpoint for each of a plurality of time steps in the future time period. The temperature setpoints achieve a target value of the cost function over the future time period. The operations also include controlling the cooling equipment to drive the indoor air temperature towards the temperature setpoint for a first time step of the plurality of time steps.

In some embodiments, the temperature bound includes an upper limit on the indoor air temperature and a lower limit on the indoor air temperature, the penalty term is zero when the indoor air temperature is between the upper limit and the lower limit, and the penalty term is non-zero when the indoor air temperature is above the upper limit or below the lower limit.

In some embodiments, the temperature bound includes a first temperature bound that includes a first upper limit on the indoor air temperature and a first lower limit on the indoor air temperature and a second temperature bound that includes a second upper limit on the indoor air temperature and a second lower limit on the indoor air temperature.

In some embodiments, the one or more non-transitory computer-readable media store a mapping between a plurality of possible states and a plurality of possible temperature bounds. The plurality of possible temperature states includes the current state and the plurality of possible temperature bounds include the temperature bound.

BRIEF DESCRIPTION OF THE DRAWINGS

FIG. 11 is a table of classifications for use by the system manager of FIG. 6, according to an exemplary embodiment.

DETAILED DESCRIPTION

Variable Refrigerant Flow Systems

Figure 1A:
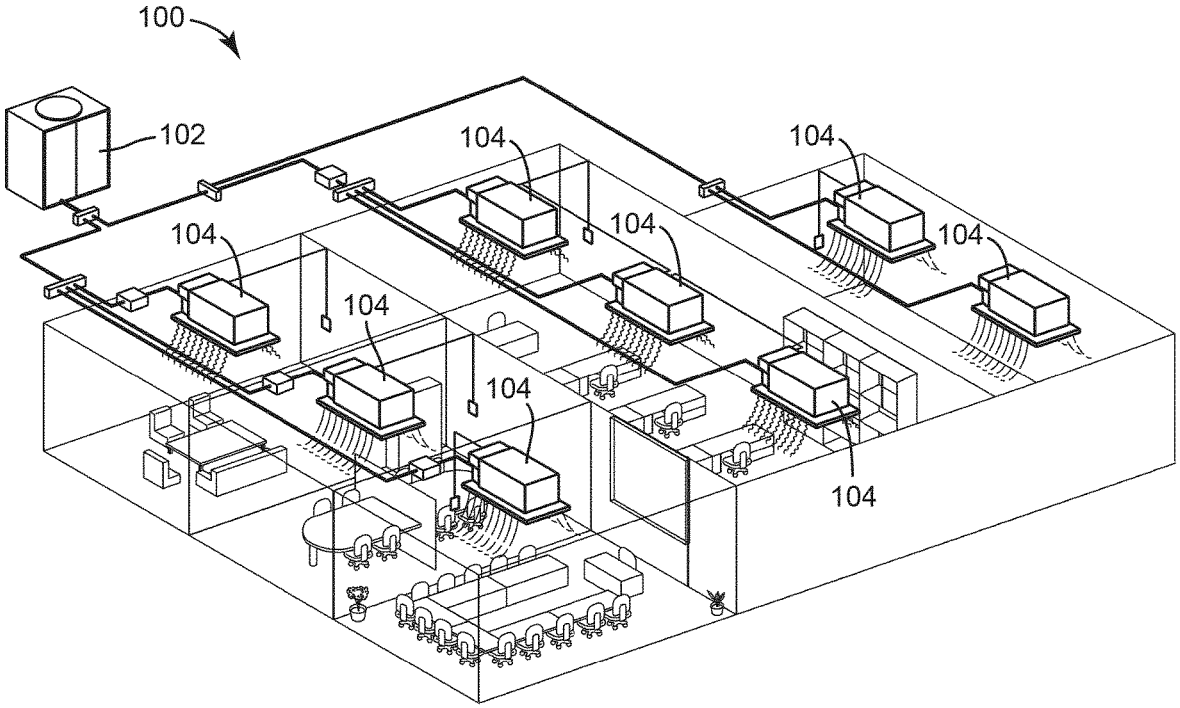
FIG. 1A is a diagram of a building served by a variable refrigerant flow system, according to an exemplary embodiment.
Figure 1B:
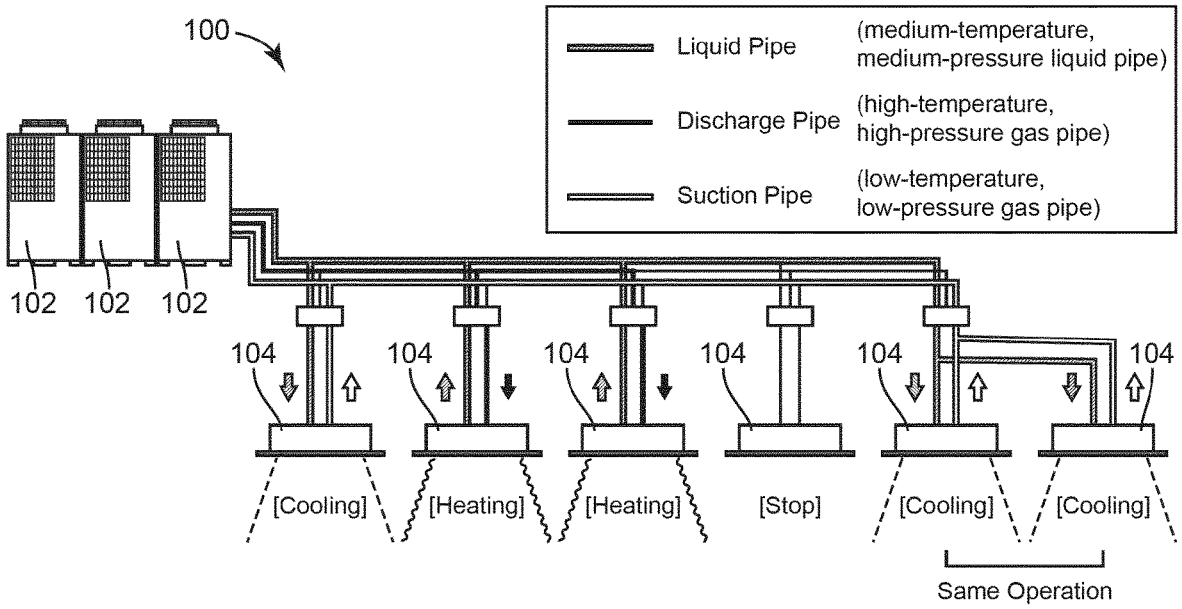
FIG. 1B is a diagram of the variable refrigerant flow system of FIG. 1A, according to an exemplary embodiment.

Referring now to FIGS. 1A-B, a variable refrigerant flow (VRF) system 100 is shown, according to some embodiments. VRF system 100 is shown to include one or more outdoor VRF units 102 and a plurality of indoor VRF units 104. Outdoor VRF units 102 can be located outside a building and can operate to heat or cool a refrigerant. Outdoor VRF units 102 can consume electricity to convert refrigerant between liquid, gas, and/or super-heated gas phases. Indoor VRF units 104 can be distributed throughout various building zones within a building and can receive the heated or cooled refrigerant from outdoor VRF units 102. Each indoor VRF unit 104 can provide temperature control for the particular building zone in which the indoor VRF unit 104 is located. Although the term "indoor" is used to denote that the indoor VRF units 104 are typically located inside of buildings, in some cases one or more indoor VRF units are located "outdoors" (i.e., outside of a building) for example to heat/cool a patio, entryway, walkway, etc.

One advantage of VRF system 100 is that some indoor VRF units 104 can operate in a cooling mode while other indoor VRF units 104 operate in a heating mode. For example, each of outdoor VRF units 102 and indoor VRF units 104 can operate in a heating mode, a cooling mode, or an off mode. Each building zone can be controlled independently and can have different temperature setpoints. In some embodiments, each building has up to three outdoor VRF units 102 located outside the building (e.g., on a rooftop) and up to 128 indoor VRF units 104 distributed throughout the building (e.g., in various building zones). Building zones may include, among other possibilities, apartment units, offices, retail spaces, and common areas. In some cases, various building zones are owned, leased, or otherwise occupied by a variety of tenants, all served by the VRF system 100.

Many different configurations exist for VRF system 100. In some embodiments, VRF system 100 is a two-pipe system in which each outdoor VRF unit 102 connects to a single refrigerant return line and a single refrigerant outlet line. In a two-pipe system, all of outdoor VRF units 102 may operate in the same mode since only one of a heated or chilled refrigerant can be provided via the single refrigerant outlet line. In other embodiments, VRF system 100 is a three-pipe system in which each outdoor VRF unit 102 connects to a refrigerant return line, a hot refrigerant outlet line, and a cold refrigerant outlet line. In a three-pipe system, both heating and cooling can be provided simultaneously via the dual refrigerant outlet lines. An example of a three-pipe VRF system is described in detail with reference to FIG. 2.

Figure 2:
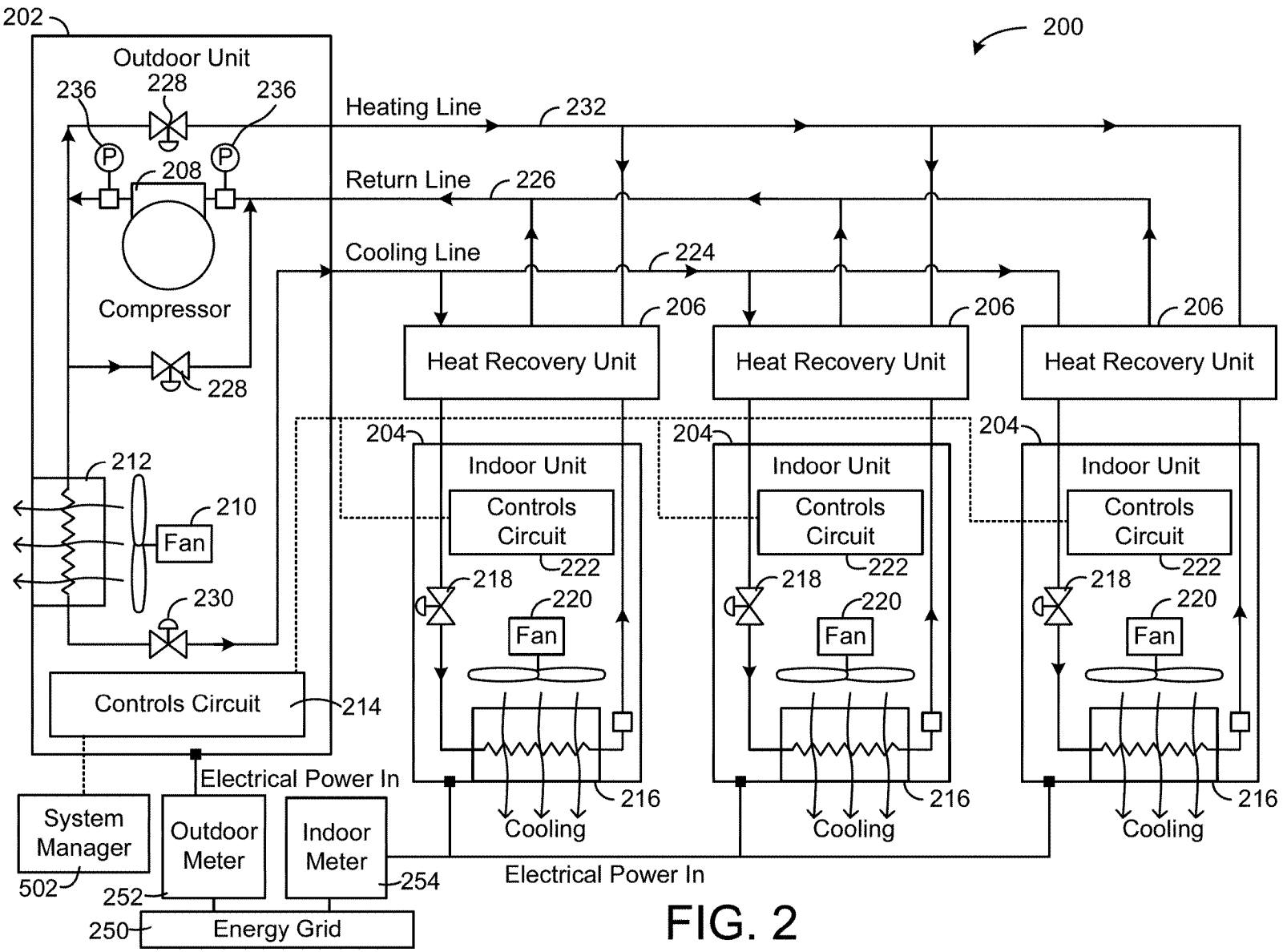
FIG. 2 is a detailed diagram of a variable refrigerant flow system, according to an exemplary embodiment.

Referring now to FIG. 2, a block diagram illustrating a VRF system 200 is shown, according to some embodiments. VRF system 200 is shown to include outdoor VRF unit 202, several heat recovery units 206, and several indoor VRF units 204. Outdoor VRF unit 202 may include a compressor 208, a fan 210, or other power-consuming refrigeration components configured convert a refrigerant between liquid, gas, and/or super-heated gas phases. Indoor VRF units 204 can be distributed throughout various building zones within a building and can receive the heated or cooled refrigerant from outdoor VRF unit 202. Each indoor VRF unit 204 can provide temperature control for the particular building zone in which the indoor VRF unit 204 is located. Heat recovery units 206 can control the flow of a refrigerant between outdoor VRF unit 202 and indoor VRF units 204 (e.g., by opening or closing valves) and can minimize the heating or cooling load to be served by outdoor VRF unit 202.

Outdoor VRF unit 202 is shown to include a compressor 208 and a heat exchanger 212. Compressor 208 circulates a refrigerant between heat exchanger 212 and indoor VRF units 204. The compressor 208 operates at a variable frequency as controlled by outdoor unit controls circuit 214. At higher frequencies, the compressor 208 provides the indoor VRF units 204 with greater heat transfer capacity. Electrical power consumption of compressor 208 increases proportionally with compressor frequency.

Heat exchanger 212 can function as a condenser (allowing the refrigerant to reject heat to the outside air) when VRF system 200 operates in a cooling mode or as an evaporator (allowing the refrigerant to absorb heat from the outside air) when VRF system 200 operates in a heating mode. Fan 210 provides airflow through heat exchanger 212. The speed of fan 210 can be adjusted (e.g., by outdoor unit controls circuit 214) to modulate the rate of heat transfer into or out of the refrigerant in heat exchanger 212.

Each indoor VRF unit 204 is shown to include a heat exchanger 216 and an expansion valve 218. Each of heat exchangers 216 can function as a condenser (allowing the refrigerant to reject heat to the air within the room or zone) when the indoor VRF unit 204 operates in a heating mode or as an evaporator (allowing the refrigerant to absorb heat from the air within the room or zone) when the indoor VRF unit 204 operates in a cooling mode. Fans 220 provide airflow through heat exchangers 216. The speeds of fans 220 can be adjusted (e.g., by indoor unit controls circuits 222) to modulate the rate of heat transfer into or out of the refrigerant in heat exchangers 216.

In FIG. 2, indoor VRF units 204 are shown operating in the cooling mode. In the cooling mode, the refrigerant is provided to indoor VRF units 204 via cooling line 224. The refrigerant is expanded by expansion valves 218 to a cold, low pressure state and flows through heat exchangers 216 (functioning as evaporators) to absorb heat from the room or zone within the building. The heated refrigerant then flows back to outdoor VRF unit 202 via return line 226 and is compressed by compressor 208 to a hot, high pressure state. The compressed refrigerant flows through heat exchanger 212 (functioning as a condenser) and rejects heat to the outside air. The cooled refrigerant can then be provided back to indoor VRF units 204 via cooling line 224. In the cooling mode, flow control valves 228 can be closed and expansion valve 230 can be completely open.

In the heating mode, the refrigerant is provided to indoor VRF units 204 in a hot state via heating line 232. The hot refrigerant flows through heat exchangers 216 (functioning as condensers) and rejects heat to the air within the room or zone of the building. The refrigerant then flows back to outdoor VRF unit via cooling line 224 (opposite the flow direction shown in FIG. 2). The refrigerant can be expanded by expansion valve 230 to a colder, lower pressure state. The expanded refrigerant flows through heat exchanger 212 (functioning as an evaporator) and absorbs heat from the outside air. The heated refrigerant can be compressed by compressor 208 and provided back to indoor VRF units 204 via heating line 232 in a hot, compressed state. In the heating mode, flow control valves 228 can be completely open to allow the refrigerant from compressor 208 to flow into heating line 232.

As shown in FIG. 2, each indoor VRF unit 204 includes an indoor unit controls circuit 222. Indoor unit controls circuit 222 controls the operation of components of the indoor VRF unit 204, including the fan 220 and the expansion valve 218, in response to a building zone temperature setpoint or other request to provide heating/cooling to the building zone. For example, the indoor unit controls circuit 222 can generate a signal to turn the fan 220 on and off. Indoor unit controls circuit 222 also determines a heat transfer capacity required by the indoor VRF unit 204 and a frequency of compressor 208 that corresponds to that capacity. When the indoor unit controls circuit 222 determines that the indoor VRF unit 204 must provide heating or cooling of a certain capacity, the indoor unit controls circuit 222 then generates and transmits a compressor frequency request to the outdoor unit controls circuit 214 including the compressor frequency corresponding to the required capacity.

Outdoor unit controls circuit 214 receives compressor frequency requests from one or more indoor unit controls circuits 222 and aggregates the requests, for example by summing the compressor frequency requests into a compressor total frequency. In some embodiments, the compressor frequency has an upper limit, such that the compressor total frequency cannot exceed the upper limit. The outdoor unit controls circuit 214 supplies the compressor total frequency to the compressor, for example as an input frequency given to a DC inverter compressor motor of the compressor. The indoor unit controls circuits 222 and the outdoor unit controls circuit 214 thereby combine to modulate the compressor frequency to match heating/cooling demand. The outdoor unit controls circuit 214 may also generate signals to control valve positions of the flow control valves 228 and expansion valve 230, a compressor power setpoint, a refrigerant flow setpoint, a refrigerant pressure setpoint (e.g., a differential pressure setpoint for the pressure measured by pressure sensors 236), on/off commands, staging commands, or other signals that affect the operation of compressor 208, as well as control signals provided to fan 210 including a fan speed setpoint, a fan power setpoint, an airflow setpoint, on/off commands, or other signals that affect the operation of fan 210.

Indoor unit controls circuits 222 and outdoor unit controls circuit 214 may store and/or provide a data history of one or more control signals generated by or provided to the controls circuits 214, 222. For example, indoor unit controls circuits 222 may store and/or provide a log of generated compressor request frequencies, fan on/off times, and indoor VRF unit 204 on/off times. Outdoor unit controls circuit 214 may store and/or provide a log of compressor request frequencies and/or compressor total frequencies and compressor runtimes.

The VRF system 200 is shown as running on electrical power provided by an energy grid 250 via an outdoor meter 252 and an indoor meter 254. According to various embodiments, the energy grid 250 is any supply of electricity, for example an electrical grid maintained by a utility company and supplied with power by one or more power plants. The outdoor meter 252 measures the electrical power consumption over time of the outdoor VRF unit 202, for example in kilowatt-hours (kWh). The indoor meter 254 measures the electrical power consumption over time of the indoor VRF units 204, for example in kWh. The VRF system 200 incurs energy consumption costs based on the metered electrical power consumption of the outdoor meter 252 and/or the indoor meter 254, as billed by the utility company that provides the electrical power. The price of electrical power (e.g., dollars per kWh) may vary over time.

The VRF system 200 also includes a system manager 502. As described in detail below with reference to FIGS. 6-13, the system manager 502 is configured to minimize energy consumption costs for the VRF system 200 while also maintaining occupant comfort.

Window Air Conditioner

Figure 3:
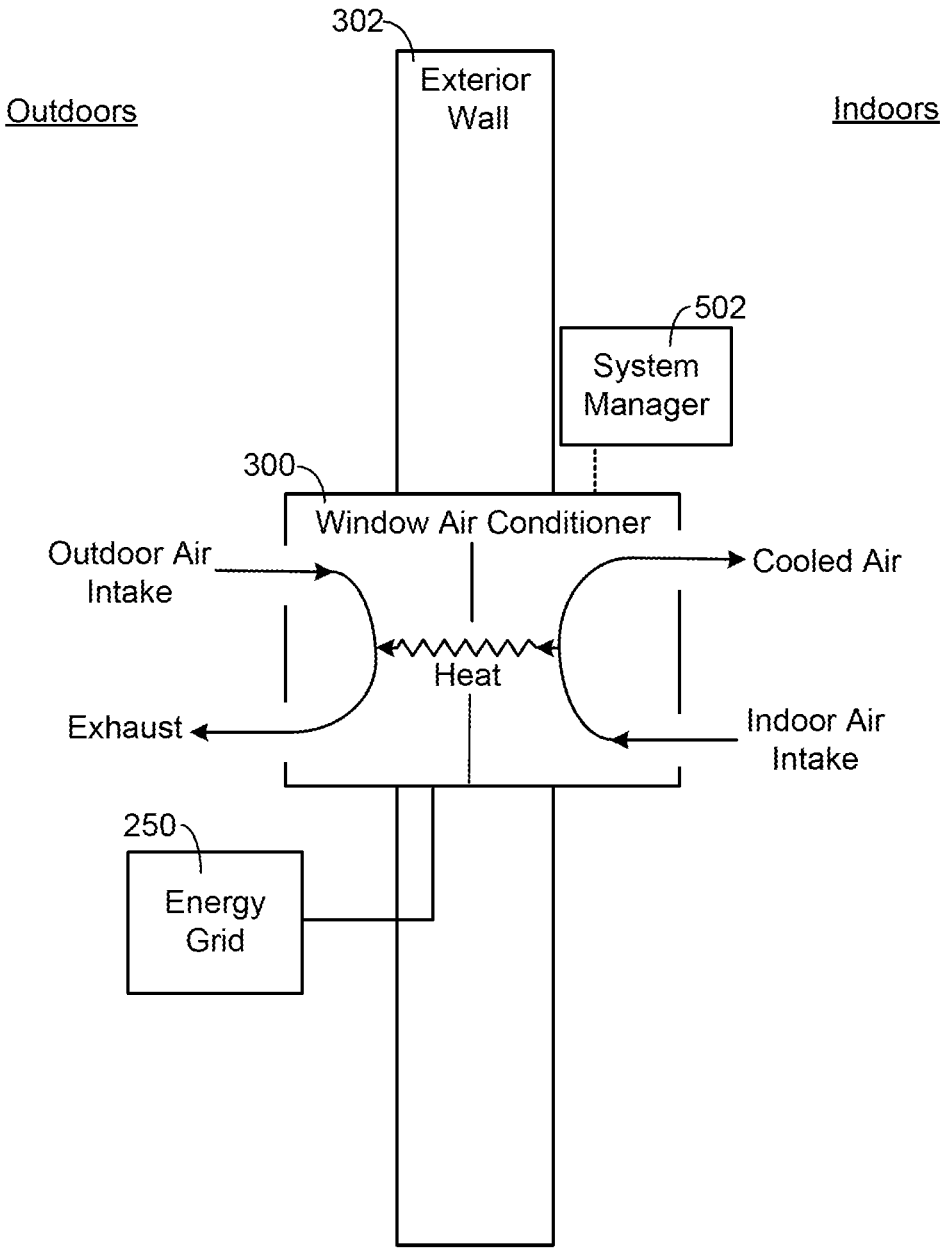
FIG. 3 is a block diagram of a window air conditioner, according to an exemplary embodiment.

Referring now to FIG. 3, a window air conditioner 300 is shown, according to an exemplary embodiment. The window air conditioner 300 is configured to be mounted in a window of a building, such that the window air conditioner 300 extends across an exterior wall 302 of the building. The window air conditioner 300 can thereby provide airflow to and/or receive air from both indoors (i.e., inside a building) and outdoors (i.e., outside of a building). A window air conditioner 300 is sometimes also referred to in the art as a room air conditioner.

The window air conditioner 300 acts as a heat pump to transfer heat from the indoor air to the outdoor air. As shown in FIG. 3, the window air conditioner 300 intakes indoor air and outputs cooled air into the room. The window air conditioner 300 also intakes outdoor air and outputs exhaust outside of the building. The window air conditioner 300 may include a compressor, a condenser, an evaporator, and one or more fans to facilitate the transfer of heat across the exterior wall 302 (i.e., from indoors to outdoors). The window air conditioner 300 is thereby configured to cause the temperature of the indoor air to decrease towards a temperature setpoint.

The window air conditioner 300 consumes electrical power from the energy grid 250 when operating to transfer heat across the exterior wall 302. The window air conditioner 300 may be controllable to operate at various powers to provide various levels of cooling to the building, for example based on a temperature setpoint. The window air conditioner 300 may also turn on and off as needed. The window air conditioner 300 therefore consumes more electrical power when providing more cooling and less electrical power when providing less cooling.

The system manager 502 is communicably coupled to the window air conditioner 300 to provide control signals for the window air conditioner 300 and to receive data from the window air conditioner 300. For example, the system manager 502 may provide a temperature setpoint to the window air conditioner 300. The system manager 502 is described in detail with reference to FIGS. 6-13. In some embodiments, the system manager 502 is integrated into the window air conditioner 300. In some embodiments, the system manager 502 operates remotely (e.g., on cloud server) and/or serves multiple window air conditioners 300.

Room Air Conditioning System

Figure 4:
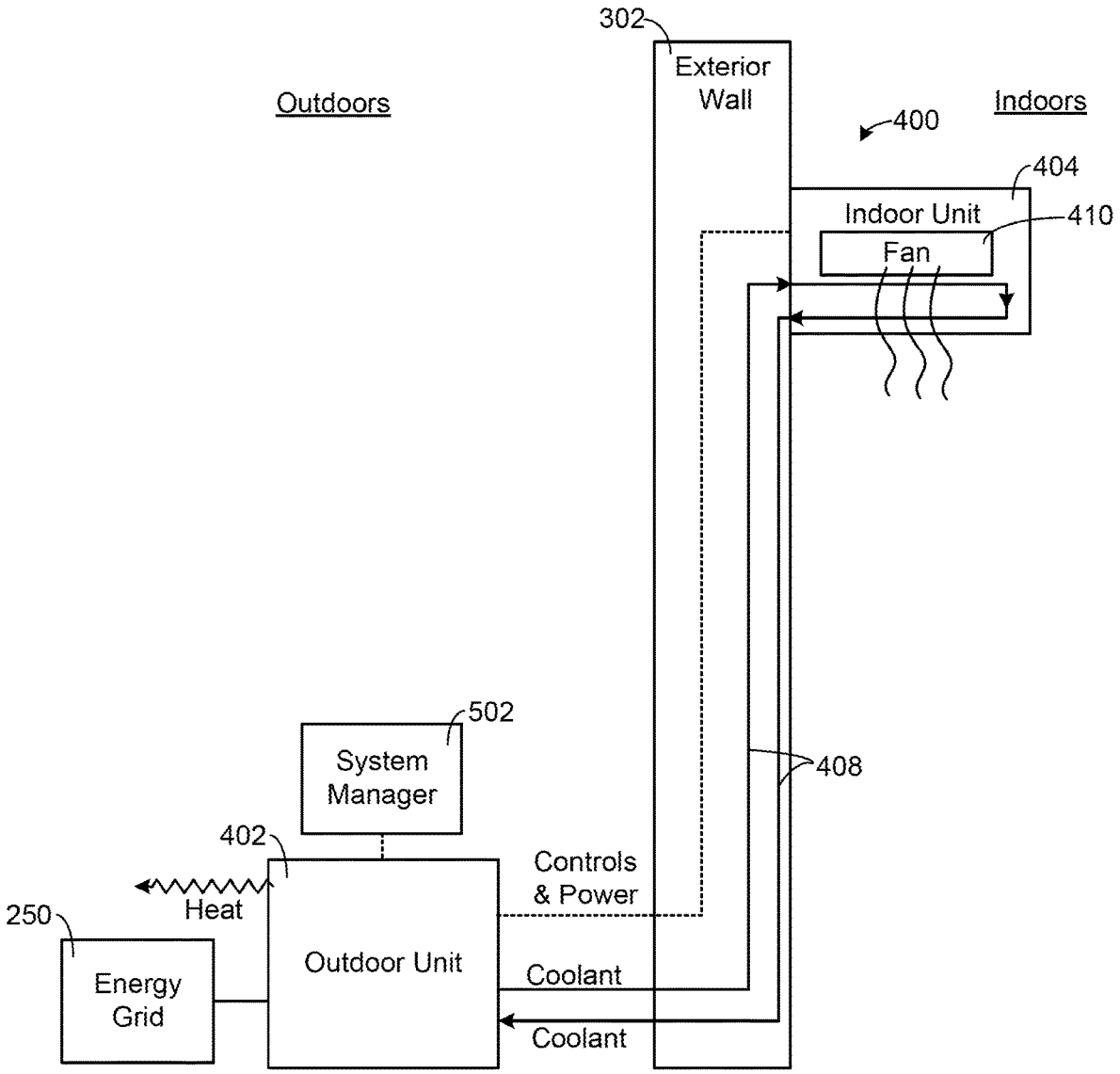
FIG. 4 is a block diagram of a room air conditioning system, according to an exemplary embodiment.

Referring now to FIG. 4, a room air conditioning system 400 is shown, according to an exemplary embodiment. The room air conditioning system 400 provides cooling for a room of a building. The room air conditioning system 400 includes in outdoor unit 402 and an indoor unit 404. The outdoor unit 402 is located outside of the building while the indoor unit 404 is located inside of the building, such that the indoor unit 404 is separated from the outdoor unit 402 by an exterior wall 302 of the building. The indoor unit 404 may be mounted on an indoor surface of the exterior wall 302. The indoor unit 404 and the outdoor unit 402 are communicably coupled to exchange control signals and data. The indoor unit 404 may also receive electrical power via the outdoor unit 402, or vice versa.

The outdoor unit 402 consumes electrical power from the energy grid 250 to cool a coolant. The coolant is then forced through pipe 408, which runs through the exterior wall 406 from the outdoor unit 402 to the indoor unit 404. A fan 410 blows air from the room across the pipe 408 to transfer heat from the room to the coolant. The coolant then flows back to the outdoor unit 402 where it is re-cooled for circulation back to the indoor unit 404. The room air conditioning system 400 thereby operates to transfer heat across the exterior wall 302 from indoors to outdoors.

The outdoor unit 402 and the indoor unit 404 may be controlled to track a temperature setpoint for the room. For example, the outdoor unit 402 may be controlled to run at various powers to provide variable rates of coolant flow and/or various coolant temperatures to the indoor unit 404. The fan 410 may be controlled to operate at various speeds. The room air conditioning system 400 is also controllable to turn on and off as needed. Accordingly, the room air conditioning system 400 consumes more electrical power from the energy grid 250 when it provides more cooling to the room.

The system manager 502 is communicably coupled to the outdoor unit 402 and/or the indoor unit 404 to provide control signals for the room air conditioner system 400 and to receive data from the room air conditioner system 400. For example, the system manager 502 may provide a temperature setpoint to the room air conditioner system 400. The system manager 502 is described in detail with reference to FIGS. 6-13. In some embodiments, the system manager 502 is integrated into the outdoor unit 402 and/or the indoor unit 404. In some embodiments, the system manager 502 operates remotely (e.g., on cloud server) and/or serves multiple room air conditioner systems 400.

Packaged Air Conditioner

Figure 5:
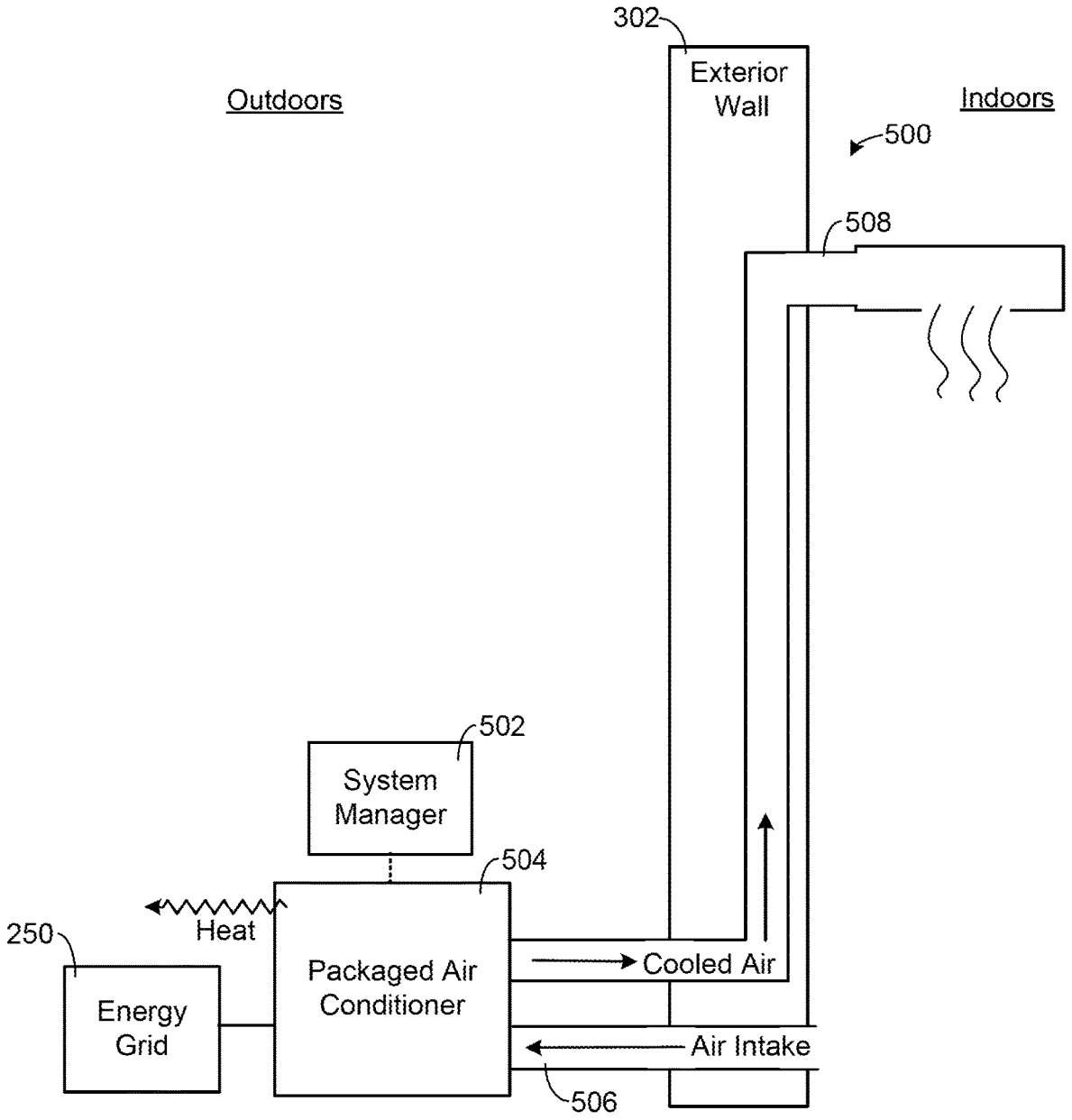
FIG. 5 is a block diagram of a packaged air conditioner system, according to an exemplary embodiment.

Referring now to FIG. 5, a packaged air conditioner system 500 is shown, according to an exemplary embodiment. The packaged air conditioner system 500 includes a packaged air conditioner 504, an air intake vent 506, and a cooled air duct 508. The packaged air conditioner 504 is located outdoors while the air intake vent 506 and the cooled air duct 508 extend from the packaged air conditioner 504 through the exterior wall 302 of a building to allow air to flow between the packaged air conditioner 504 and the inside of the building.

The packaged air conditioner system 500 consumes electrical power from energy grid 250 to draw in indoor air from inside the building through the air intake vent 506, remove heat from the indoor air to cool the air, and provide the cooled air to the cooled air duct 508. The packaged air conditioner system 500 expels the heat to the outdoor air. The cooled air duct 508 allows the cooled air to flow across the exterior wall 302 and into the air in the building to lower the indoor air temperature of the building.

The packaged air conditioner 504 may be controlled to track a temperature setpoint for the building. For example, the packaged air conditioner 504 may be operated at various powers to provide various temperatures of cooled air and/or various flow rates of cooled air to the cooled air duct 508. The packaged air conditioner 504 consumes more electrical power from the energy grid 250 when it provides more cooling to the room, by operating at a higher rate of power consumption and/or by operating for more time.

The system manager 502 is communicably coupled to the packaged air conditioner 504 to provide control signals for the room air conditioner system 400 and to receive data from the packaged air conditioner 504. For example, the system manager 502 may provide a temperature setpoint to the packaged air conditioner 504. The system manager 502 is described in detail with reference to FIGS. 6-13. In some embodiments, the system manager 502 is integrated into the packaged air conditioner 504. In some embodiments, the packaged air conditioner 504 operates remotely (e.g., on cloud server) and/or serves multiple room air conditioner systems 400.

System Manager with Cost Target Optimization

Figure 6:
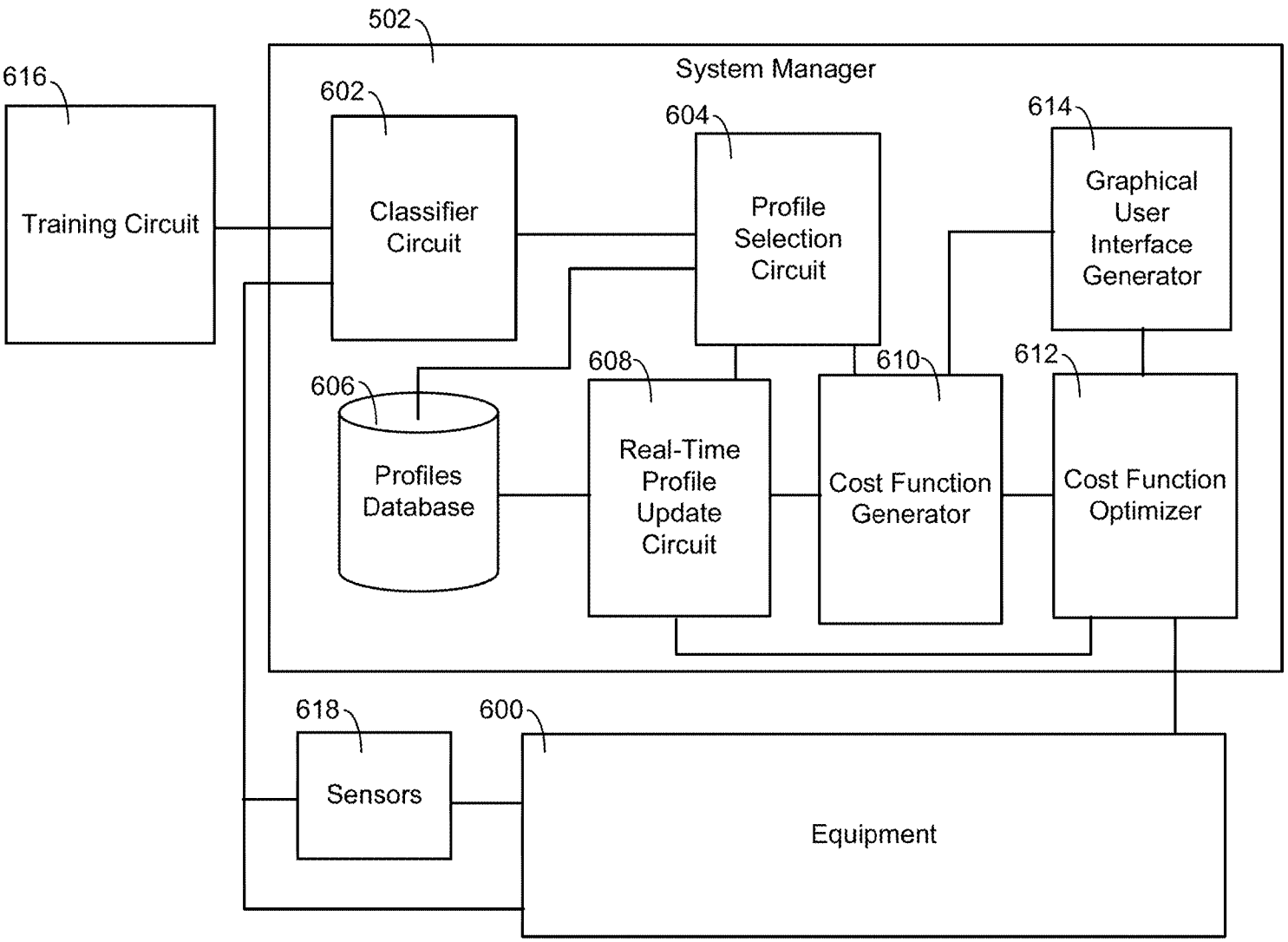
FIG. 6 is a block diagram of a system manager for use with a variable refrigerant flow system, a room air conditioner system, a window air conditioner, and/or a packaged air conditioner, according to an exemplary embodiment.

Referring now to FIG. 6, a block diagram illustrating the system manager 502 in greater detail is shown, according to an exemplary embodiment. As described in detail below, the system manager 502 can be configured to generate a cost function that uses penalty terms to account for occupant comfort and optimize the cost function while constrained by a maximum energy cost to determine a control input for equipment 600. The system manager 502 can determine the penalty terms by identifying a classification for the state of the building using a neural network and then associating that classification with maximum and minimum temperature profiles. These and other functions of the system manager 502 are described in detail below.

The system manager 502 may be communicably coupled to equipment 600 and sensors 618. According to various embodiments, the equipment 600 includes the VRF system 100 of FIGS. 1A-B, the VRF system 200 of FIG. 2, the window air conditioner 300 of FIG. 3, the room air conditioning system 400 of FIG. 4, and/or the packaged air conditioner system 500 of FIG. 5. Equipment 600 is operable to affect the indoor air temperature of one or more of a room, multiple rooms, a building, multiple buildings, etc. Sensors 618 provide measurements that facilitate the operation of equipment 600 and system manager 502. Sensors 618 may measure the indoor air temperature of a room or building, an outdoor air temperature, and/or a humidity of a room or building.

The system manager 502 is shown to include a classifier circuit 602, a profile selection circuit 604, a profiles database 606, a real-time profile update circuit 608, a cost function generator 610, a cost function optimizer 612, and a graphical user interface generator 614. The system manager 502 is communicable with a training circuit 616. As described in further detail below, the classifier circuit 602 uses a neural network and data about the equipment 600 and the building it serves to classify a current status of the building. The classifier circuit 602 provides the classification to the profile selection circuit 604, which associates the classification with a maximum temperature profile and a minimum temperature profile using a look-up table stored in the profiles database 606. The maximum temperature profile and the minimum temperature profile represent bounds on a range of comfortable temperatures for each time step in a planning period (e.g., each hour of the next 24 hours). The real-time profile update circuit 608 is configured to update the maximum temperature profile and/or minimum temperature profile in real-time based on a user change to a temperature setpoint or other user input.

The cost function generator 610 receives the maximum temperature profile and the minimum temperature profile and uses the profiles to generate a cost function. The cost function includes an energy consumption cost term and a penalty term defined by the maximum temperature profile and the minimum temperature profile. The cost function may be represented as:

$$\sum_{i=1}^{NH} C_i P_i \Delta t_i + \sum_{j=1}^{M} C_j \max_{R_j}(P_j) + \sum_{i=1}^{NH} Soft_i \Delta t_i + \sum_{i=1}^{NH} Hard_i \Delta t_i V_N(\theta, Z^N) = \sum_{k=1}^{N-h_{max}+1} \sum_{h=0}^{h_{max}} w(h) \| y(k+h) - \hat{y}(k+h \mid k-1, \theta) \|_2^2.$$

where NH is a total number of time steps in a period, $\Delta t_i$ is the length of each time step, $P_i$ is the power consumed by the equipment 600 in time step i, $C_i$ is the price per unit power charged by a utility company during time step i, $Soft_i$ is a soft penalty function, and $Hard_i$ is a hard penalty function. The term $$\sum_{j=1}^{M} C_j \max_{R_j}(P_j)$$

captures a maximum demand charge billed by a utility company for the maximum power requested for each time step between j=1 and M within a demand charge period. The cost function generator 610 may also set an inequality constraint to bound overall cost as less than a maximum energy consumption cost. In some embodiments, the maximum cost constraint sets a bound on the total value of the entire cost function above. In other embodiments the maximum cost constraint does not apply to the penalty terms (i.e., the value of $$\sum_{i=1}^{NH} C_i P_i \Delta t_i + \sum_{j=1}^{M} C_j \max_{R_j}(P_j)$$

is bound by the maximum cost constraint). An inequality constraint can therefore ensure that a user's budget for utility charges for a time period is not exceeded.

The cost function optimizer 612 receives the cost function from the cost function generator 610. The cost function optimizer 612 determines a temperature setpoint trajectory for the planning period that minimizes the cost function without exceeding the maximum cost constraint for the planning period. The temperature setpoint trajectory includes a temperature setpoint for each time step in the planning period. The cost function optimizer 612 may use a model predictive control approach to predict future temperatures, prices, etc. for the planning period to facilitate optimization over the planning period. The temperature setpoint trajectory is then provided to the equipment 600. The equipment 600 operates to affect the indoor air temperature of the building to track the temperature setpoint trajectory.

In some embodiments, the graphical user interface generator 614 is configured to generate a graphical user interface that visualizes the optimization problem faced by cost function optimizer 612 and allows a user to input the maximum energy consumption cost that defines the maximum cost constraint. Examples of such graphical user interfaces are shown in FIGS. 7-9 and described in detail with reference thereto.

Figure 7:
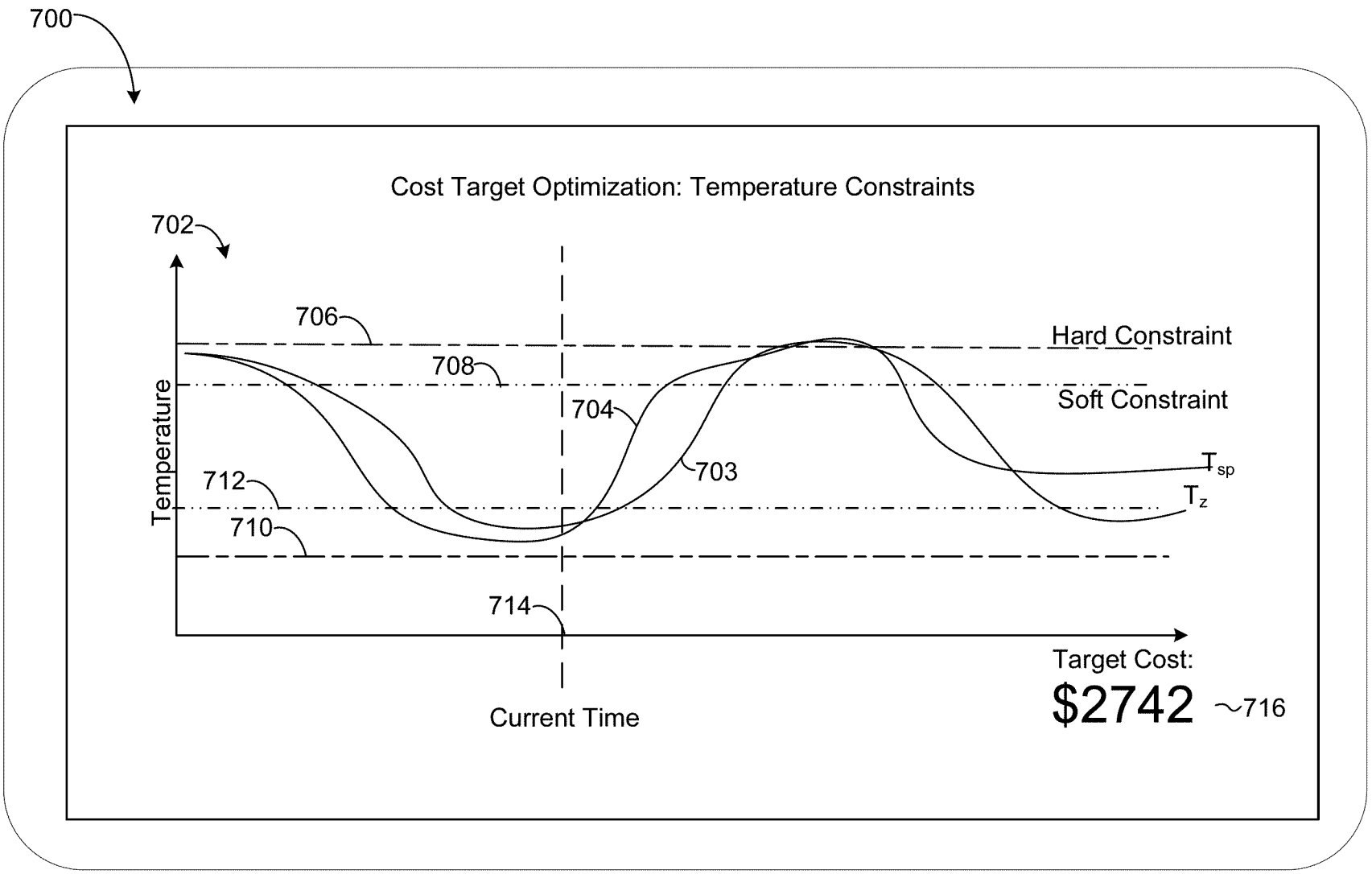
FIG. 7 is a graphical user interface showing a first graph that illustrates a cost target optimization problem solved by the system manager of FIG. 6, according to an exemplary embodiment.
Figure 8:
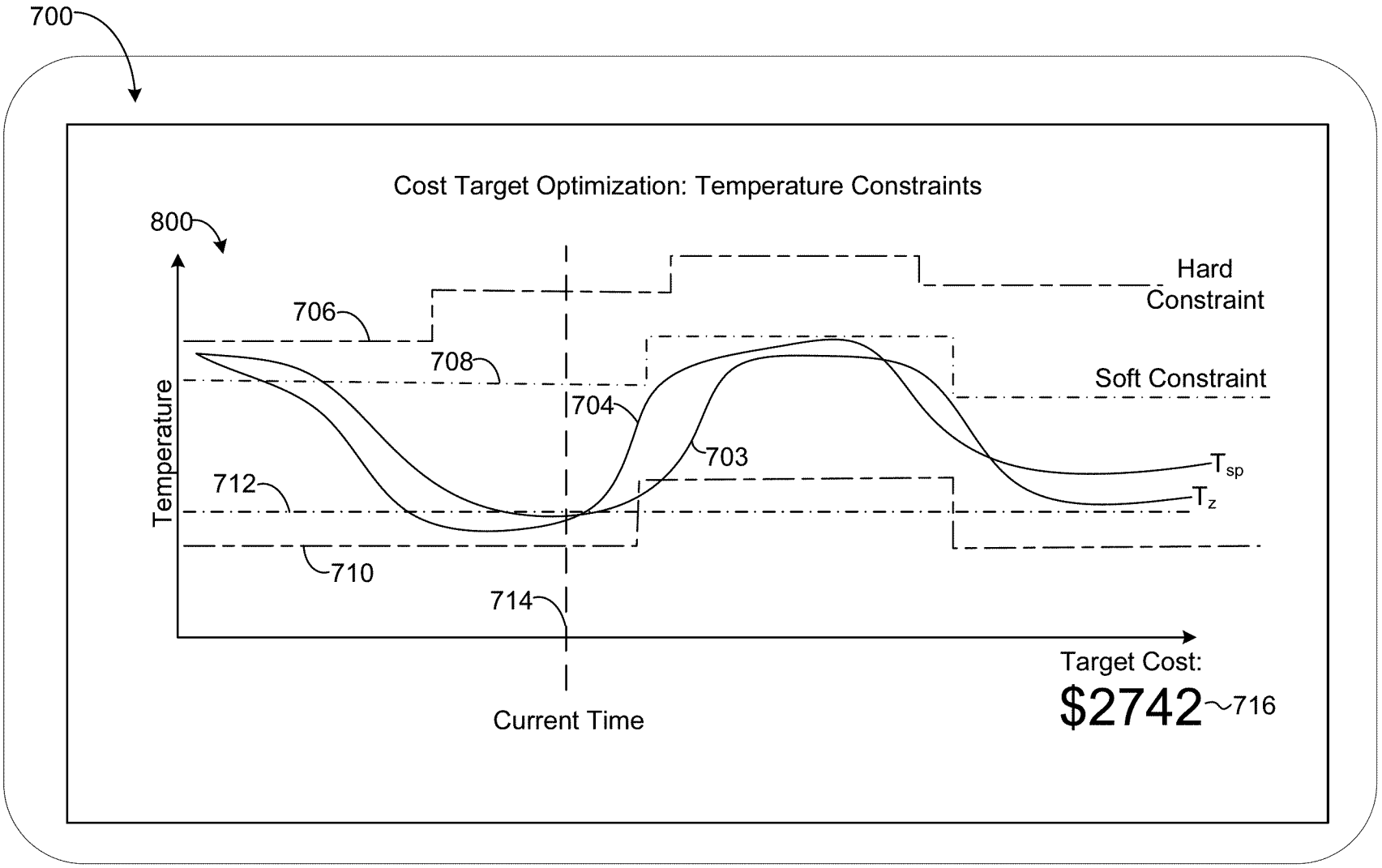
FIG. 8 is a graphical user interface showing a second graph that illustrates a cost target optimization problem solved by the system manager of FIG. 6, according to an exemplary embodiment.
Figure 9:
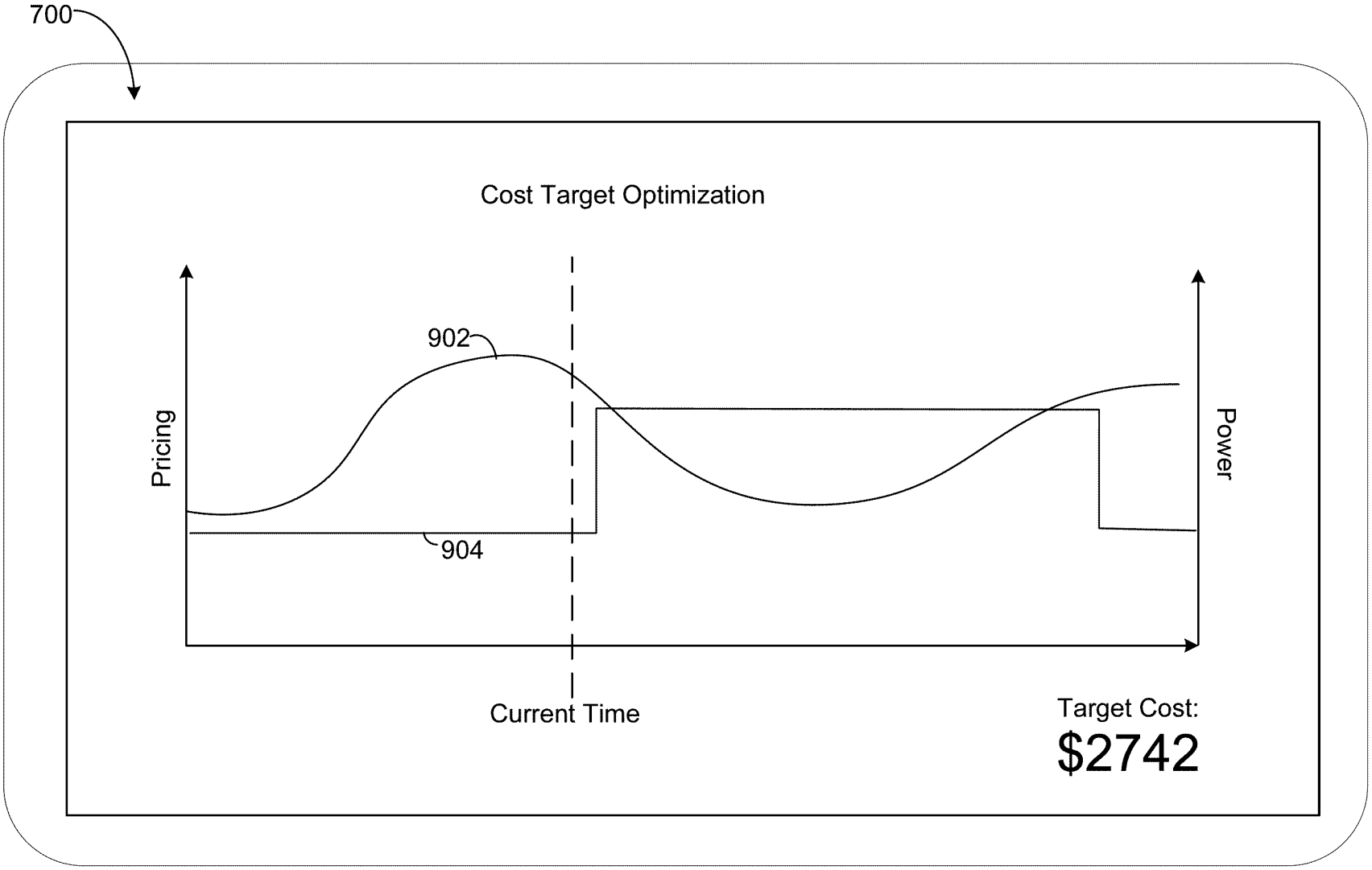
FIG. 9 is a graphical user interface showing a third graph that illustrates a cost target optimization problem solved by the system manager of FIG. 6, according to an exemplary embodiment.

Referring now to FIGS. 7-9, a graphical user interface 700 showing graph 702, graph 800, and graph 900 that illustrates the optimization problem solved by the cost function optimizer 612 is shown, according to an exemplary embodiment. FIG. 7 shows graph 702, FIG. 8 shows graph 800, and FIG. 9 shows graph 900. The graphical user interface 700 may be generated by the graphical user interface generator 614 and presented on a user's personal computing device (e.g., smartphone, tablet, personal computer), on a display of the equipment 600, or on some other interface.

Graph 702 of FIG. 7 shows an indoor air temperature $T_z$ line 703, a temperature setpoint line 704, a hard-constraint temperature maximum line 706, a soft-constraint temperature maximum line 708, a hard-constraint temperature minimum line 710, and a soft-constraint temperature minimum line 712. A bar 714 indicates the current time, such that lines 703-712 to the right of the bar 714 are in the future and lines 703-712 to the left of the bar 714 represent historical data. The graphical user interface 700 also shows target cost 716 that sets a maximum energy consumption cost for a planning period. The target cost 716 may be altered by a user to change the maximum energy consumption cost for the planning period. In some embodiments, the user may also alter the temperature constraints by repositioning the hard-constraint temperature maximum line 706, soft-constraint temperature maximum line 708, hard-constraint temperature minimum line 710, and/or soft-constraint temperature minimum line 712.

The hard-constraint temperature maximum line 706, soft-constraint temperature maximum line 708, hard-constraint temperature minimum line 710, and soft-constraint temperature minimum line 712 indicate the threshold values used in the penalty functions generated by the cost function generator 610. The soft constraint penalty function $Soft_i$ is zero when the indoor air temperature $T_z$ line 703 is between the soft-constraint temperature maximum line 708 and the soft-constraint temperature minimum line 712, and a soft penalty value when the indoor air temperature $T_z$ line 703 is above the soft-constraint temperature maximum line 708 or below the soft-constraint temperature minimum line 712. That is, $Soft_i$ applies a soft penalty value to the cost function when the indoor air temperature $T_z$ is outside a preferred temperature range. One example of the soft constraint penalty function $Soft_i$ is:

$$Soft_i = w_{soft} * \max(0, T_{z,i} - T_{max,soft,i}, T_{min,soft,i} - T_{z,i})$$

where $T_{max,soft,i}$ is the value of the soft-constraint temperature maximum line 708 at time step i, $T_{min,soft,i}$ is the value of the soft-constraint temperature minimum line 712 at time step i, $T_{z,i}$ is the value of the indoor air temperature line 703 at time step i, and $w_{soft}$ is the penalty weight applied to the soft penalty.

The hard constraint penalty function $Hard_i$ is zero when the indoor air temperature $T_z$ line 703 is between the hard-constraint temperature maximum line 706 and the hard-constraint temperature minimum line 710, and has a hard penalty value when the indoor air temperature $T_z$ line 703 is above the hard-constraint temperature maximum line 706 or below the hard-constraint temperature minimum line 710. That is, $Hard_i$ applies a hard penalty value to the cost function when the indoor air temperature $T_z$ is outside of a comfortable temperature range (i.e., the indoor air is uncomfortably cold or hot). The hard penalty value is substantially larger than the soft penalty value (e.g., 10 times larger, 100 times larger, 1000 times larger). One example of the hard constraint penalty function $Hard_i$ is:

$$Hard_i = w_{hard} * \max(0, T_{z,i} - T_{max,hard,i}, T_{min,hard,i} - T_{z,i})$$

where $T_{max,hard,i}$ is the value of the hard-constraint temperature maximum line 706 at time step i, $T_{min,hard,i}$ is the value of the hard-constraint temperature minimum line 710 at time step i, is the value of the indoor air temperature line 703 at time step i, and $w_{hard}$ is the penalty weight applied to the hard penalty ($w_{hard} > w_{soft}$).

The soft constraint penalty function $Soft_i$ and the hard constraint penalty function $Hard_i$ thereby incorporate occupant comfort into the cost function. Further, because $Soft_i$ and $Hard_i$ are implemented as penalty functions rather than inequality constraints on the optimization problem, the solution to the optimization problem may include allowing the indoor air temperature $T_z$ to drift to uncomfortable temperatures (i.e., exceed the soft or hard constraints) when the trade-off with energy consumption cost savings is great enough. Stated another way, the soft constraint penalty function $Soft_i$ and the hard constraint penalty function $Hard_i$ are included in the cost function to quantify occupant comfort. Optimizing the cost function thus includes optimizing occupant comfort.

Graph 800 of FIG. 8 also shows the indoor air temperature $T_z$ line 703, the temperature setpoint line 704, the hard-constraint temperature maximum line 706, the soft-constraint temperature maximum line 708, the hard-constraint temperature minimum line 710, and the soft-constraint temperature minimum line 712. Graph 800 is included to illustrate that the hard-constraint temperature maximum line 706, the soft-constraint temperature maximum line 708, the hard-constraint temperature minimum line 710, and the soft-constraint temperature minimum line 712 may vary over time. As described in detail below, the hard-constraint temperature maximum line 706, the soft-constraint temperature maximum line 708, the hard-constraint temperature minimum line 710, and the soft-constraint temperature minimum line 712 are determined based on a maximum temperature profile and a minimum temperature profile selected by the profile selection circuit 604 based on a classification determined by the classifier circuit 602.

Graph 900 of FIG. 9 shows a power line 902 and a pricing line 904. The power line 902 shows the operating power of the equipment 600 over time, including both past and predicted operating powers. The pricing line 904 shows the price of the power consumed by the equipment 600, for example as set by a utility company that provides electricity for the equipment 600. Graph 900 illustrates that energy prices may vary over time, and that the cost function optimizer 612 may consider changes in energy prices over time when determining a temperature setpoint trajectory for the planning period. For example, the cost function optimizer 612 may predict future energy prices for use in optimizing the cost function.

Figure 10:
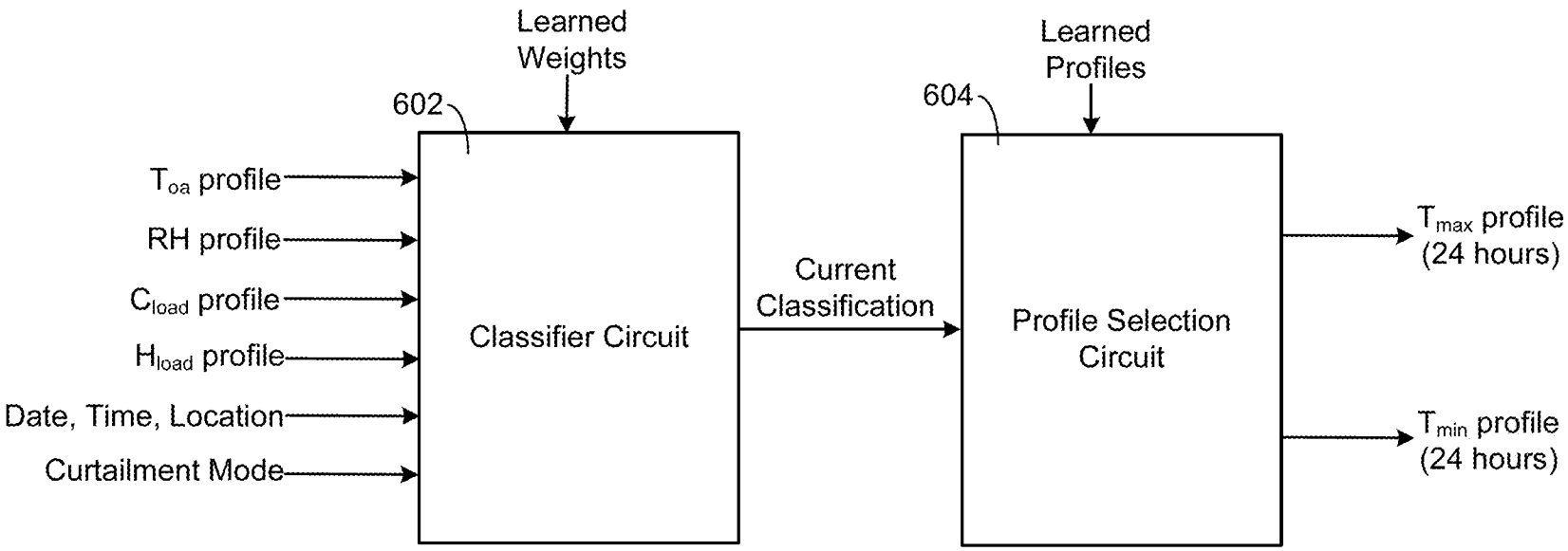
FIG. 10 is a block diagram of a classifier circuit and a profile selection circuit of the system manager of FIG. 6, according to an exemplary embodiment.

Referring now to FIG. 10, a detailed view of the classifier circuit 602 and the profile selection circuit 604 of the system manager 502 are shown, according to an exemplary embodiment.

The classifier circuit 602 receives various inputs and outputs a current classification for the building. The inputs may include an outdoor air temperature ($T_{oa}$) profile that provides air temperature outside the building for multiple times steps in a time period. The $T_{oa}$ profile may be based on recorded measurements, weather forecasts, or some combination thereof. The inputs may also include a room humidity or relative humidity (RH) profile that provides the humidity of the room/building for multiple time steps in a time period. The RH profile may be based on recorded measurements, humidity predictions, or some combination thereof. The classifier circuit 602 also receives a cooling load ($C_{load}$) profile and a heating load ($H_{load}$) profile. The cooling load profile and the heating load profile capture the level of demand for cooling and heating for each time step in the time period. The classifier circuit 602 also takes in a date, time, and location of the equipment 600 and/or the building, as well as a curtailment mode for the building.

The classifier circuit 602 processes those inputs and determines a current classification for the building and equipment 600. The current classification is chosen from a set of possible classifications. In various embodiments, many classification systems are possible. In the embodiment shown, the set of possible classifications is illustrated by the table 1100 of FIG. 11. The table 1100 includes six categories, including outside air temperature $T_{oa}$, room humidity RH, Cold Load, Hot Load, Season, and Curtailment. Each of the six categories has five associated statuses. To pick a current classification, one status is chosen from each of the six categories. Table 1100 thereby shows a set of possible classifications that includes $5^6$=15625 possible classifications.

To associate the inputs with a classification, the classifier circuit 602 utilizes a neural network, for example a convolutional neural network. A neural network is an artificially-intelligent software program that models neurons to create a program that associates inputs with outputs without requiring an explicit statement of the rules that determine the associations. A convolutional neural network is organized in layers, passing data from an input layer to an output layer via multiple hidden layers. The convolutional neural network uses learned weights in processing the data and generating outputs. Here, learned weights are generated by the training circuit 616 as described in detail below with reference to FIG. 12.

The classifier circuit 602 thereby receives inputs relating to the building and/or equipment 600 and uses learned weights in a convolutional neural network to determine a current classification. The classifier circuit 602 then provides the current classification to the profile selection circuit 604.

The profile selection circuit 604 associates the current classification with a $T_{max}$ profile and a $T_{min}$ profile. The profile selection circuit 604 may communicate with the profiles database 606 to access a look-up table of associations between each possible input and a $T_{max}$ profile and a $T_{min}$ profile. The profile selection circuit 604 may then find the current classification on the look-up table and identify the corresponding $T_{max}$ and $T_{min}$ profiles. Each $T_{max}$ profile defines an upper constraint on the inside air temperature for each time step over a planning period (e.g., each hour for 24 hours), while each $T_{min}$ profile defines a lower constraint on the outside air temperature for each time step over the planning period. In some embodiments, the $T_{max}$ and Tan profiles define both hard constraints and soft constraints for each time step corresponding to the penalty functions $Soft_i$ and $Hard_i$ discussed above. That is, in such embodiments, the $T_{max}$ profile defines the soft-constraint temperature maximum line 708 and the hard-constraint temperature maximum line 706 of FIGS. 7 and 8, while the $T_{min}$ profile defines the soft-constraint temperature minimum line 712 and the hard-constraint temperature minimum line 710 of FIGS. 7 and 8. In other embodiments, the hard and soft constraints are derived in other some way from the $T_{max}$ and $T_{min}$ profiles (e.g., by using the $T_{max}$ profile as the soft constraint and adding a constant amount to determine the hard constraint).

Together, as shown in FIG. 10, the classifier circuit 602 and the profile selection circuit 604 thereby receive various inputs relating to the building and/or the equipment and determine temperature constraints for an optimization problem based on the inputs.

Figure 12:
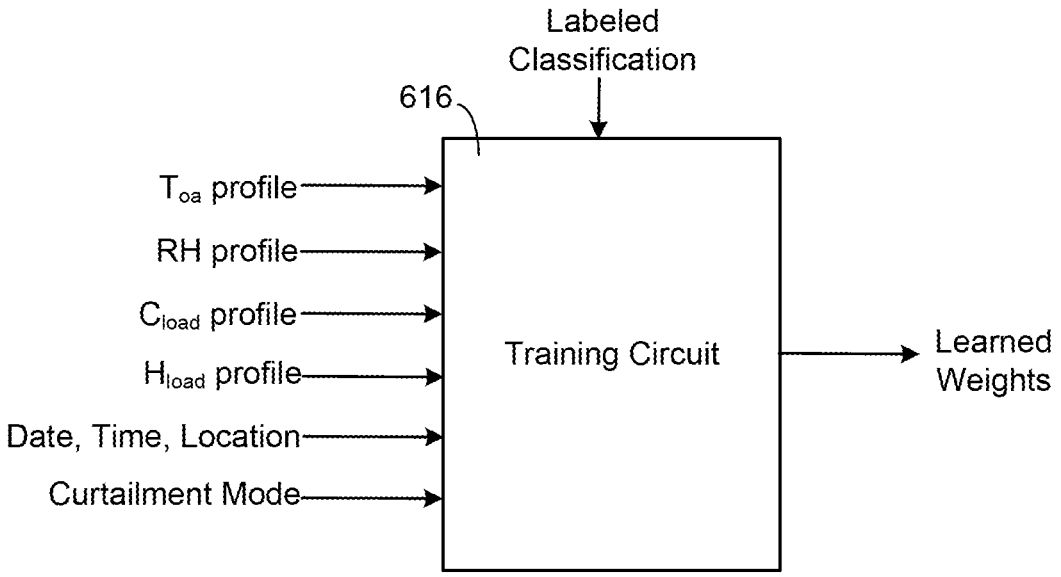
FIG. 12 is a block diagram of a training circuit for use with the system manager of FIG. 6, according to an exemplary embodiment.

Referring now to FIG. 12, the training circuit 616 is shown, according to an exemplary embodiment. The training circuit 616 determines learned weights for use in the neural network of the classifier circuit 602. The training circuit 616 may run 'offline' (i.e., outside of an operational control loop of the system manager 502), and may primarily be used during creation and installation of the system manager 502. The learned weights may be determined in advance of real-time operation of the system manager 502, thereby making the classification process substantially more efficient.

The training circuit 616 may use supervised learning, model-driven unsupervised learning, or some other approach. In supervised learning, the training circuit 616 receives input data for the same categories as the classifier circuit 602 ($T_{oa}$ profile, RH profile, $C_{load}$ profile, $H_{load}$ profile, date, time, location, curtailment mode), receives the current classification from a user (i.e., human) and learns weights for the neural network based on the association between the inputs and the user-determined current classification. By receiving a large dataset of inputs and outputs in this way, the training circuit 616 is supplied with data that allows the training circuit 616 to automatically determine a set of learned weights that tune the neural network to automatically make those same associations. Supervised learning may be conducted with real data from the building and/or equipment 600, or may be applied using simulated inputs and prompts for user determination of classifications based on those simulated inputs.

In a model-driven unsupervised learning approach, a model of the building and equipment 600 is used to determine current classifications (in contrast to having user-provided current classifications as in the supervised learning approach). The outputs are predicted by pre-programmable modeling techniques that are capable of supplying accurate classifications based on the same inputs but which may be too computationally expensive for use in on-line control. The model is thus used to generate the data received by the training circuit 616 and used to train the neural network (i.e., to determine the learned weights). The convolutional neural network of the classifier circuit 602 is substantially more efficient (i.e., faster, requires less computing resources, etc.) than the non-AI modeling approach used to generate data for unsupervised learning.

In various other embodiments, other now known or later developed approaches to training neural networks may also be used by the training circuit 616 to provide the learned weights used by the classifier circuit 602.

Figure 13:
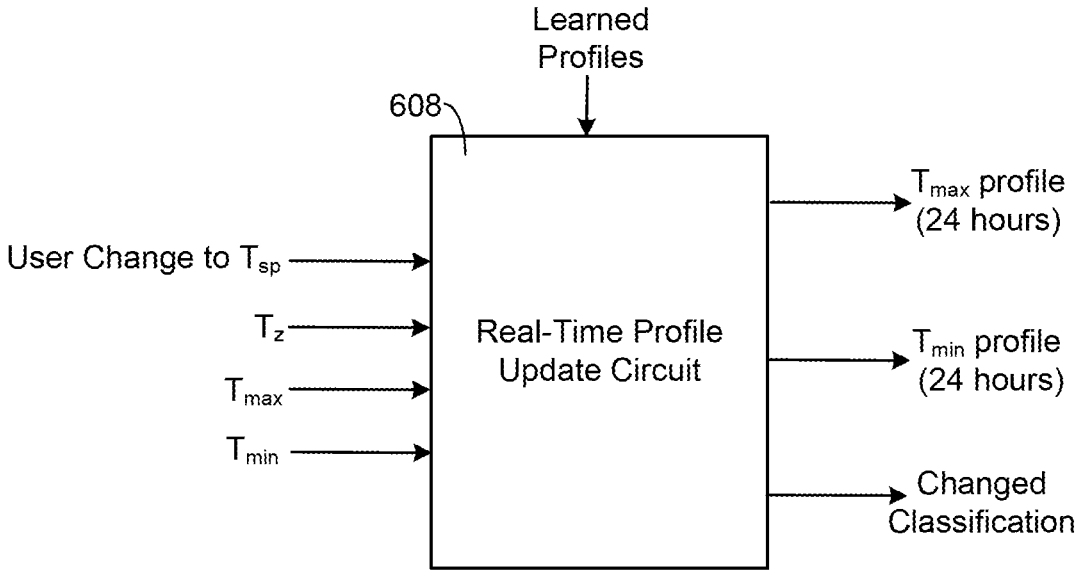
FIG. 13 is a block diagram of a real-time profile update circuit of the system manager of FIG. 6, according to an exemplary embodiment.

Referring now to FIG. 13, the real-time profile update circuit 608 of the system manager 502 is shown, according to an exemplary embodiment. The real-time profile update circuit 608 is configured to update the current classification, the $T_{max}$ profile, and/or the $T_{min}$ profile based on a user input to change a temperature setpoint.

The temperature setpoint supplied to the equipment may be determined by the system manager 502 (e.g., by the cost function optimizer 612), and may also be changed by a user (e.g., via a graphical user interface generated by the graphical user interface generator 614). When the user changes the temperature setpoint, the change in temperature setpoint $T_{sp}$ is provided to the real-time profile update circuit 608. The real-time profile update circuit 608 also receives the current indoor air temperature $T_z$ and the current temperature constraints ($T_{max}$ and $T_{min}$).

The real-time profile update circuit 608 determines whether the change in temperature setpoint $T_{sp}$ requires a change in the current classification, the $T_{max}$ profile, and/or the $T_{min}$ profile, and, if so, determines the new current classification, $T_{max}$ profile, and/or the $T_{min}$ profile. For example, if the change in $T_{sp}$ changes $T_{sp}$ to be greater than $T_{max}$, the real-time profile update circuit 608 may determine that the $T_{max}$ profile should be shifted upwards for the rest of the planning period. As another example, if the change in $T_{sp}$ changes $T_{sp}$ to be less than $T_{min}$, the real-time profile update circuit 608 may determine that the $T_{min}$ profile should be shifted downwards for the rest of the planning period. The real-time profile update circuit 608 may also communicate with the profiles database 606 to update the $T_{max}$ profile for the current classification accordingly. If $T_{sp}$ is changed to value between $T_{min}$ and $T_{max}$, the real-time profile update circuit 608 may determine that the current classification, the $T_{max}$ profile, and the $T_{min}$ profile need not be updated.

In some cases, the real-time profile update circuit 608 may determine that the user's change in $T_{sp}$ indicates that the current classification should be updated to a changed classification. The real-time profile update circuit 608 then accesses the profiles database 606 to determine a new classification and provides that changed classification to the profile selection circuit 604.

The real-time profile update circuit 608 thereby allows the system manager 502 to analyze the constraints on the cost-function optimization problem in real time to better minimize occupant discomfort.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more processors communicably coupled to one or more memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multithreaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations. The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A building cooling system comprising:

a cooling device operable to affect an indoor air temperature of a building;

a controller configured to:

obtain a cost function that characterizes a cost of operating the cooling device over a future time period;

obtain a dataset comprising a plurality of data points relating to the building;

determine a current state of the building by applying the dataset to a neural network configured to classify the current state of the building;

select a temperature bound associated with the current state;

augment the cost function to include a penalty term that increases the cost when the indoor air temperature violates the temperature bound; and determine a temperature setpoint for each of a plurality of time steps in the future time period, the temperature setpoints achieving a target value of the cost function over the future time period; and control the cooling device to drive the indoor air temperature towards the temperature setpoint for a first time step of the plurality of time steps.

2. The building cooling system of claim 1, wherein the temperature bound comprises an upper limit on the indoor air temperature and a lower limit on the indoor air temperature.

3. The building cooling system of claim 2, wherein the penalty term is zero when the indoor air temperature is between the upper limit and the lower limit; and wherein the penalty term is non-zero when the indoor air temperature is above the upper limit or below the lower limit.

4. The building cooling system of claim 1, wherein the temperature bound comprises:

a first temperature bound comprising a first upper limit on the indoor air temperature and a first lower limit on the indoor air temperature; and a second temperature bound comprising a second upper limit on the indoor air temperature and a second lower limit on the indoor air temperature.

5. The building cooling system of claim 4, wherein the penalty term increases the cost by a first amount when the first temperature bound is violated and by a second amount when the second temperature bound is violated, the second amount greater than the first amount.

6. The building cooling system of claim 5, wherein the first upper limit is less than the second upper limit and the first lower limit is greater than the second lower limit.

7. The building cooling system of claim 1, wherein the controller is configured to generate a graphical user interface that prompts a user to input the target value of the cost function.

8. The building cooling system of claim 1, wherein the controller is configured to store a mapping between a plurality of possible states of the building and a plurality of possible temperature bounds, the plurality of possible states comprising the current state and the plurality of possible temperature bounds comprising the temperature bound.

9. The building cooling system of claim 1, wherein the cooling device comprises a variable refrigerant flow unit, a room air conditioning unit, or a packaged air conditioning unit.

10. A method comprising:

obtaining a cost function that characterizes a cost of operating a cooling device over a future time period, the cooling device configured to affect an indoor air temperature of a space;

obtaining a dataset comprising a plurality of data points relating to the space;

determining a current state of the space by applying the dataset to a neural network configured to classify the current state of the space;

selecting a temperature bound associated with the current state;

augmenting the cost function to include a penalty term that increases the cost when the indoor air temperature violates the temperature bound;

determining a temperature setpoint for each of a plurality of time steps in the future time period, the temperature setpoints achieving a target value of the cost function over the future time period; and controlling the cooling device to drive the indoor air temperature towards the temperature setpoint for a first time step of the plurality of time steps.

11. The method of claim 10, wherein:

the temperature bound comprises an upper limit on the indoor air temperature and a lower limit on the indoor air temperature;

the penalty term is zero when the indoor air temperature is between the upper limit and the lower limit; and the penalty term is non-zero when the indoor air temperature is above the upper limit or below the lower limit.

12. The method of claim 10, wherein the temperature bound comprises:

a first temperature bound comprising a first upper limit on the indoor air temperature and a first lower limit on the indoor air temperature; and a second temperature bound comprising a second upper limit on the indoor air temperature and a second lower limit on the indoor air temperature.

13. The method of claim 12, wherein:

the first upper limit is less than the second upper limit and the first lower limit is greater than the second lower limit; and the penalty term increases the cost by a first amount when the first temperature bound is violated and by a second amount when the second temperature bound is violated, the second amount greater than the first amount.

14. The method of claim 10, comprising prompting a user to input the target value of the cost function via a graphical user interface.

15. The method of claim 10, comprising displaying a graphical representation of the temperature bound for the future time period and the temperature setpoints for the future time period.

16. The method of claim 10, wherein the cooling device comprises a variable refrigerant flow unit, a room air conditioning unit, or a packaged air conditioning unit.

17. One or more non-transitory computer-readable media containing program instructions that, when executed by one or more processors, cause the one or more processors to perform operations comprising:

obtaining a cost function that characterizes a cost of operating cooling equipment over a future time period, the cooling equipment configured to affect an indoor air temperature of one or more buildings, the cooling equipment comprising one or more of a variable refrigerant flow system, a room air conditioning system, or a packaged air conditioning system;

obtaining a dataset comprising a plurality of data points relating to the one or more buildings;

determining a current state of the one or more buildings by applying the dataset to a neural network configured to classify the current state of the one or more buildings;

selecting a temperature bound associated with the current state;

augmenting the cost function to include a penalty term that increases the cost when the indoor air temperature violates the temperature bound;

determining a temperature setpoint for each of a plurality of time steps in the future time period, the temperature setpoints achieving a target value of the cost function over the future time period; and controlling the cooling equipment to drive the indoor air temperature towards the temperature setpoint for a first time step of the plurality of time steps.

18. The non-transitory computer-readable media of claim 17, wherein:

the temperature bound comprises an upper limit on the indoor air temperature and a lower limit on the indoor air temperature;

the penalty term is zero when the indoor air temperature is between the upper limit and the lower limit; and the penalty term is non-zero when the indoor air temperature is above the upper limit or below the lower limit.

19. The non-transitory computer-readable media of claim 17, wherein the temperature bound comprises:

a first temperature bound comprising a first upper limit on the indoor air temperature and a first lower limit on the indoor air temperature; and a second temperature bound comprising a second upper limit on the indoor air temperature and a second lower limit on the indoor air temperature.

20. The non-transitory computer-readable media of claim 19, wherein the one or more non-transitory computer-readable media store a mapping between a plurality of possible states of the one or more buildings and a plurality of possible temperature bounds, the plurality of possible states comprising the current state and the plurality of possible temperature bounds comprising the temperature bound.

* * * * *